US007946124B2

(12) United States Patent
Klysen

(10) Patent No.: US 7,946,124 B2
(45) Date of Patent: May 24, 2011

(54) TEMPERATURE CONTROLLED STORAGE FACILITIES AND METHODS

(75) Inventor: Jeremy John Klysen, Hastings, MN (US)

(73) Assignee: Leo A. Daly Company, Omaha, NE (US)

( * ) Notice: Subject to any disclaimer, the term of this patent is extended or adjusted under 35 U.S.C. 154(b) by 397 days.

(21) Appl. No.: 11/900,774

(22) Filed: Sep. 12, 2007

(65) Prior Publication Data

US 2008/0178616 A1 Jul. 31, 2008

Related U.S. Application Data

(60) Provisional application No. 60/897,808, filed on Jan. 25, 2007.

(51) Int. Cl.

| | |
|---|---|
| ***F25D 23/12*** | (2006.01) |
| ***F25D 11/00*** | (2006.01) |
| ***F25D 17/06*** | (2006.01) |
| ***E04H 1/00*** | (2006.01) |
| ***B65G 1/00*** | (2006.01) |
| ***B65G 65/00*** | (2006.01) |

(52) U.S. Cl. ..... 62/259.1; 62/440; 62/412; 52/234; 414/266; 414/281

(58) Field of Classification Search ..... 62/259.1, 62/412, 440; 414/281; 52/234
See application file for complete search history.

(56) References Cited

U.S. PATENT DOCUMENTS

| | | | | |
|---|---|---|---|---|
| 2,040,227 | A | | 5/1936 | Wernersson |
| 2,794,325 | A | | 6/1957 | Shearer |
| 2,862,369 | A | | 12/1958 | Simons |
| 3,076,320 | A | | 2/1963 | Conradi |
| 3,123,988 | A | * | 3/1964 | Richmam ..... 62/414 |
| 3,143,952 | A | | 8/1964 | Simons |
| 3,575,235 | A | | 4/1971 | Davis et al. |
| 3,998,142 | A | * | 12/1976 | Foreman et al. ..... 454/187 |
| 4,058,989 | A | | 11/1977 | Horvay et al. |
| 4,074,620 | A | | 2/1978 | Jansson |
| 4,124,996 | A | | 11/1978 | Kennedy et al. |
| 4,516,482 | A | | 5/1985 | Smith |
| 4,632,020 | A | | 12/1986 | Houwer |
| 4,824,685 | A | | 4/1989 | Bianco |
| 4,879,877 | A | | 11/1989 | Hicke |
| 5,373,780 | A | | 12/1994 | Bianco |
| 5,531,158 | A | | 7/1996 | Perryman, Jr. |
| 5,566,608 | A | | 10/1996 | Vejdani et al. |
| 5,671,609 | A | | 9/1997 | Lionetti |
| 5,778,557 | A | | 7/1998 | Leavens |
| 5,789,007 | A | | 8/1998 | Bianco |
| 5,965,185 | A | | 10/1999 | Bianco |
| 6,012,384 | A | | 1/2000 | Badalament et al. |
| 6,067,811 | A | * | 5/2000 | Shih et al. ..... 62/259.1 |
| 6,077,160 | A | | 6/2000 | Franaszek et al. |
| 6,146,267 | A | | 11/2000 | Beudon et al. |
| 6,269,652 | B1 | | 8/2001 | Grosskopf |

(Continued)

*Primary Examiner* — Ljiljana (Lil) V Ciric
*Assistant Examiner* — Filip Zec
(74) *Attorney, Agent, or Firm* — Merchant & Gould P.C.

(57) ABSTRACT

A temperature controlled storage facility includes a room having an enclosed structure, and a plurality of multi-level storage zones within the room. Each of the storage zones include a supply of temperature controlled air having two outlets, one outlet positioned adjacent to a top area of the storage area, and a second outlet positioned adjacent to an aisle, wherein pressure barriers are created to prevent air flow from migrating to other storage areas or to a return duct without cooling (or heating) all of the inventory in the storage zone.

21 Claims, 11 Drawing Sheets

U.S. PATENT DOCUMENTS 6,405,644 B1 6/2002 Windecker
6,431,060 B1 8/2002 Gutheim
6,443,056 B1 9/2002 Kiefer et al.
6,457,402 B1 10/2002 Parker et al.
6,702,663 B2 3/2004 Israel
6,715,539 B2 4/2004 Bianco
6,874,331 B2 4/2005 Chandler et al.

* cited by examiner

TEMPERATURE CONTROLLED STORAGE FACILITIES AND METHODS

CROSS REFERENCE TO RELATED APPLICATIONS

This application claims the benefit of U.S. Provisional Patent Application Ser. No. 60/897,808, filed Jan. 25, 2007, which application is incorporated herein by reference in its entirety.

TECHNICAL FIELD

The present invention relates to temperature controlled storage facilities, including freezers, coolers, and other air conditioned rooms, and related methods for controlling the temperature of an enclosed space

BACKGROUND OF THE INVENTION

Inventory management in storage facilities sometimes requires management of the temperature of the inventory, especially for perishable inventory like in the food industry. Other industries, such as pharmaceuticals and electronics, benefit from temperature management during storage. Various concerns exist for the design and function of the facility. Such concerns include avoidance of temperature gradients within the space, ease of access to the storage areas and inventory, and the density of the inventory in the facility.

Large refrigeration systems such as commercial food freezers and coolers, typically use cool air circulated around the boxes and crates of inventory to control the temperature, and the quality, of the inventory during storage. In some facilities in the past, the tops and side walls of the space were closely spaced to the inventory to get good circulation of cool air around the inventory, especially if the space had multiple stories or levels. Fans and ducting were also used to achieve desired airflows. This resulted in a cell-like structure to the site. Movement of inventory and workers was hindered by the use of the physical structures to control airflow.

In some facilities, a more open structure was used. Typically, the boxes were stored on pallets on racking, in a back-to-back manner. While these facilities were more open than the ones noted above, typically, these were less dense and used the space less efficiently than the closed room facility.

There is a need to have large open spaces to the inventory storage spaces. Such an arrangement would allow for more flexible inventory handling and distribution systems for loading and unloading in the space. However, the conditioned air must be distributed so all the inventory is maintained at an appropriate temperature. In addition, the density of the inventory storage is a concern to keep space needs to a minimum. There is an increasing demand for more efficient use of storage space. Improvements to temperature controlled storage facilities are desired.

SUMMARY OF THE INVENTION

The present invention relates to a temperature controlled storage facility comprising a room having side walls, end walls, a floor, and a ceiling defining an open interior space. A plurality of storage zones are provided in the space. The storage zones are spaced apart between the side walls within the room to define aisles. The storage zones can include multiple levels or stories. The aisles are used for airflow. The aisles may also be used for inventory traffic. The aisles are designated as either a supply air aisle or a return air aisle. The supply air aisles and the return air aisles preferably alternate across the space between the side walls.

A plurality of blower units are positioned to control temperature in each storage zone. Each blower unit includes an air source at a desired temperature, such as a fan and an evaporator, and air ducting. The air ducting includes a supply air duct connected to the air source with first and second air outlets, and a return air duct. The ducting and blower units are arranged front-to-front and back-to-back across the space. The first air outlet of each blower unit is positioned adjacent to an upper area of the storage zone, the second air outlet is positioned adjacent to a supply air aisle, and the return air duct is positioned adjacent to a return air aisle. Pressure barriers are created by the airflow to create the storage zones in the open space of the facility to manage the temperature of the inventory contained in the respective storage zones.

DETAILED DESCRIPTION OF THE PREFERRED EMBODIMENT

Figure 1:
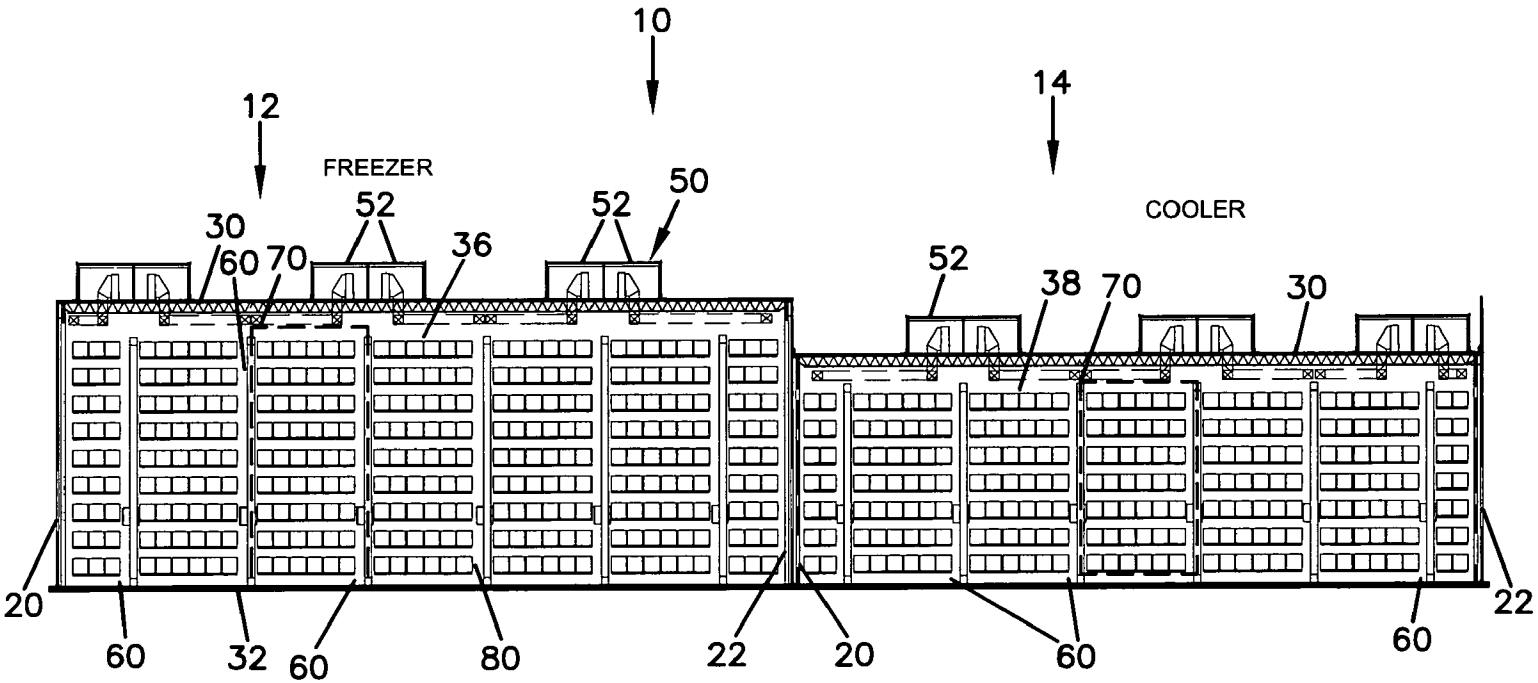
FIG. 1 is a front elevational view of one embodiment of a temperature controlled storage facility including a freezer room and a cooler room.
Figure 2:
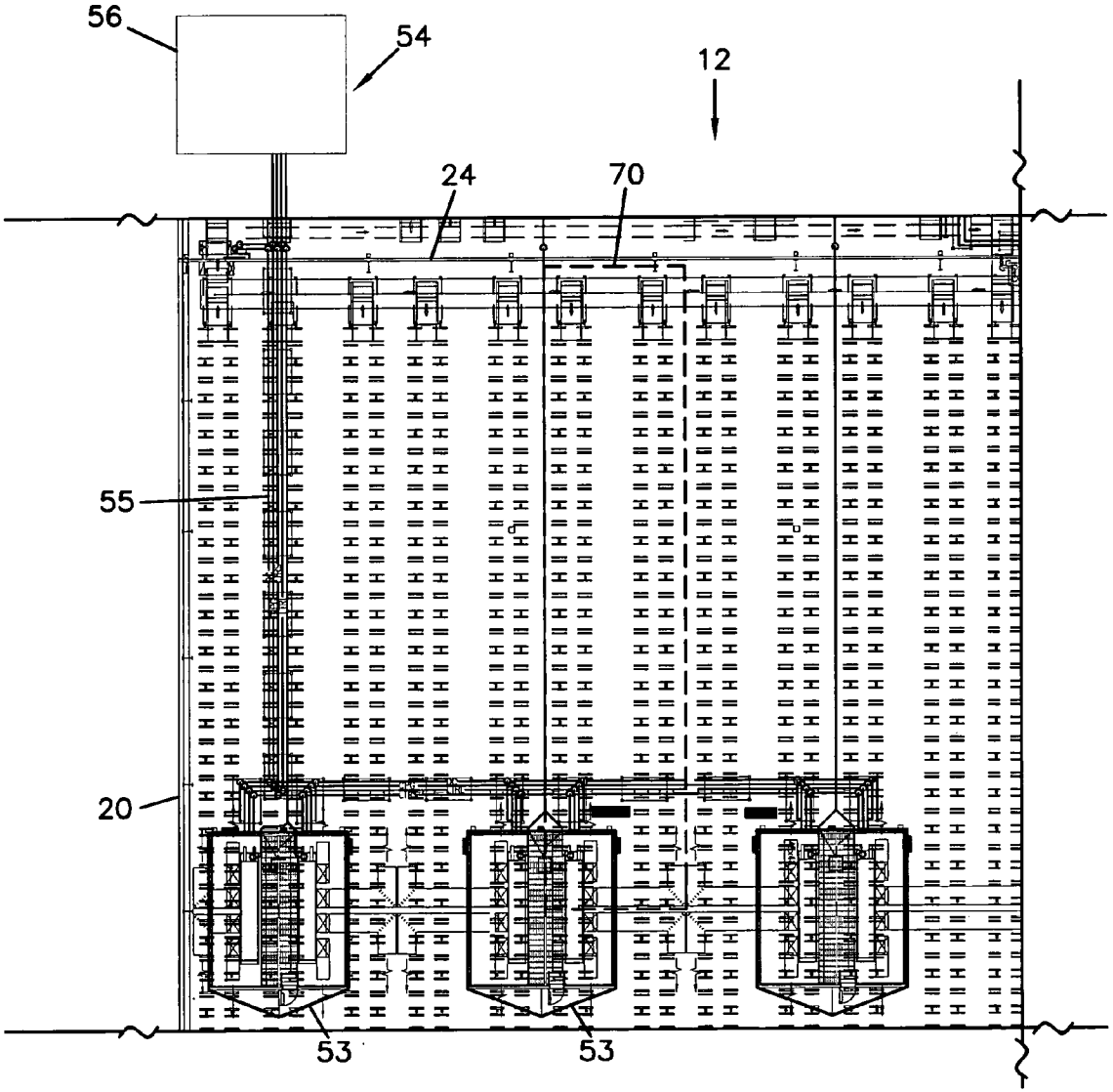
FIG. 2 is a top view of a portion of the freezer room of the facility of FIG. 1.

Refrigeration systems for storage of inventory include an enclosed cold storage area or room for temperature controlled storage of the inventory. One industry in particular where temperature control is important is the food storage industry. Referring now to FIGS. 1-6, a food refrigeration system or facility 10 in the form of a building or warehouse site is shown. System 10 includes a freezer room 12 and a cooler room 14. Each room 12, 14, includes side walls 20, 22 and end walls 24, 26. Each room 12, 14, further includes a ceiling 30, and a floor 32.

Each room 12, 14 defines an enclosed space 36, 38 where temperature control is desired. For example, in the freezer room 12, a temperature of −15 to −32 degrees Fahrenheit is desired for the temperature of the inventory. In the cooler room 14, a temperature of +32 to +70 degrees Fahrenheit is desired for the temperature of the inventory, depending on the type of product to be stored. Temperature is controlled with a cooling system 50, including a plurality of refrigeration or blower units 52 which create appropriately cooled air directed into the enclosed spaces 36, 38. As shown, refrigeration units 52 are housed in roof-mounted penthouses 53 with a blower or fan for moving air, and an evaporator and condenser system 54, typical of known refrigeration systems. Fluid lines 55 connect each penthouse 53 with a remote condenser unit 56. Typically in each penthouse 53 is a blower (fan) and evaporator unit 58. Ducting 59 leads cool air to the enclosed spaces, and for return air to exit.

Contained within each room 12, 14 are structures which allow for inventory storage, such as racking 40, which comprises a plurality of shelves or levels for holding the inventory at a variety of vertical levels relative to floor 32. Typically, the inventory is in the form of boxes 44, crates or other convenient inventory containing structures. Boxes 44 can be positioned directly on the racking or on pallets 46 for convenient inventory handling.

Each room 12, 14, includes structures and/or spacing for humans or equipment to allow handling of the inventory to put the inventory on racking 40, or to remove the inventory as needed. Typically, each room 12, 14, is provided with aisles or other passages for human traffic and human controlled equipment, and/or for automated inventory management equipment. For example, cranes, lifts, conveyors, and other inventory moving equipment may be provided. As a result, each room 12, 14, includes first areas where inventory is stored, and second areas used to access the storage areas or to move people or inventory.

System 10 including rooms 12, 14 utilizes spaced racking 40 to create a plurality of aisles 60 which allow for inventory movement and/or human traffic. As will be defined in greater detail below, each of the rooms 12, 14 includes a plurality of storage zones 70 wherein temperature of the inventory is controlled with airflow. Each storage zone 70 includes racking 40 for inventory. Inventory handling equipment for each storage zone 70 may include cranes 80. In the example system 10, cranes 80 are located in aisles 60. As shown in FIG. 3A, internal mezzanines 90 can be provided within each storage zone 70. Inventory handling equipment can be located in mezzanines 90. Mezzanines 90 may also define human traffic pathways 98 for inventory handling equipment such as pallet jacks or lift trucks.

Figure 3:
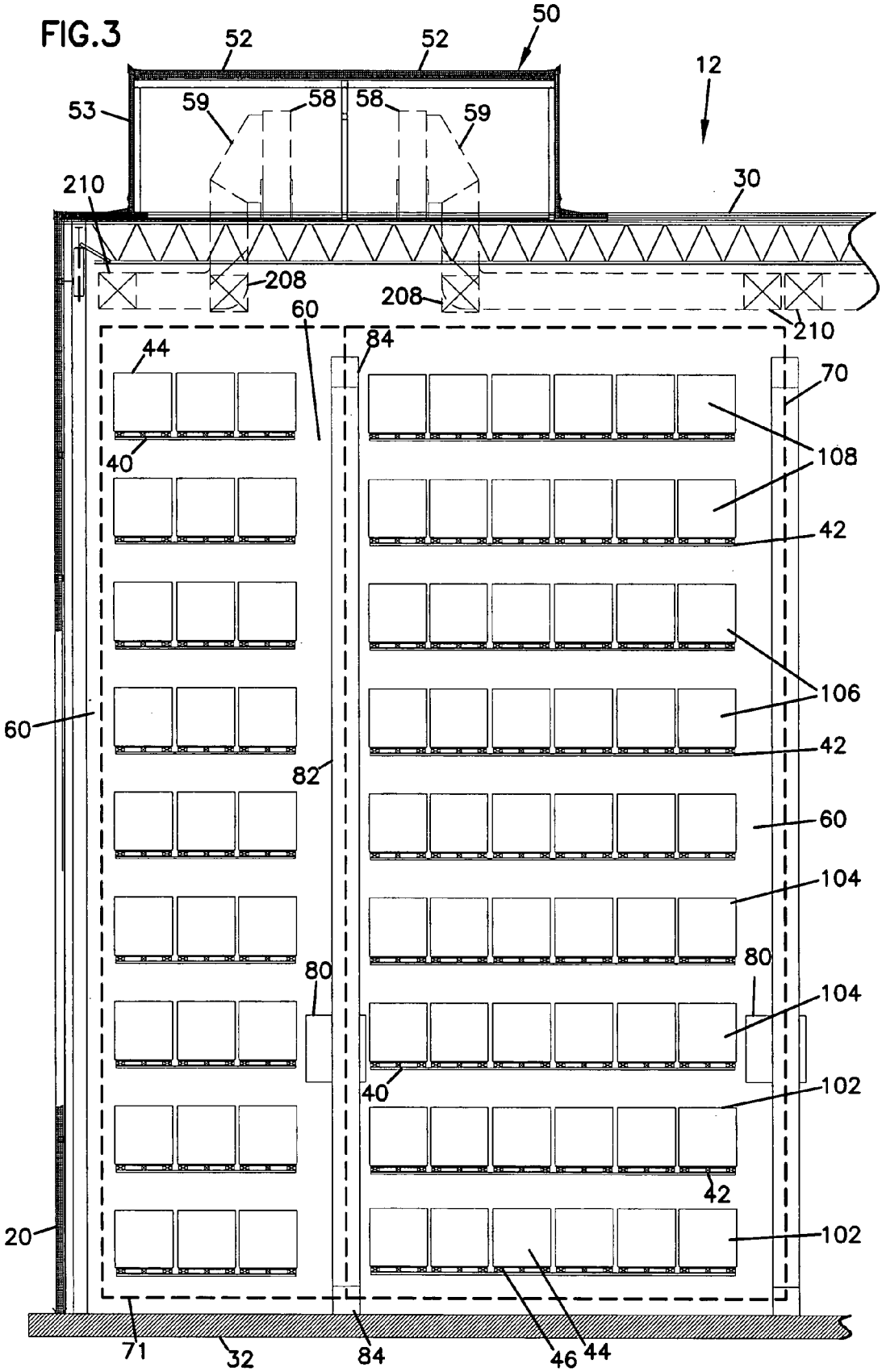
FIG. 3 is an enlarged portion of one side of the freezer room of FIG. 1.
Figure 3A:
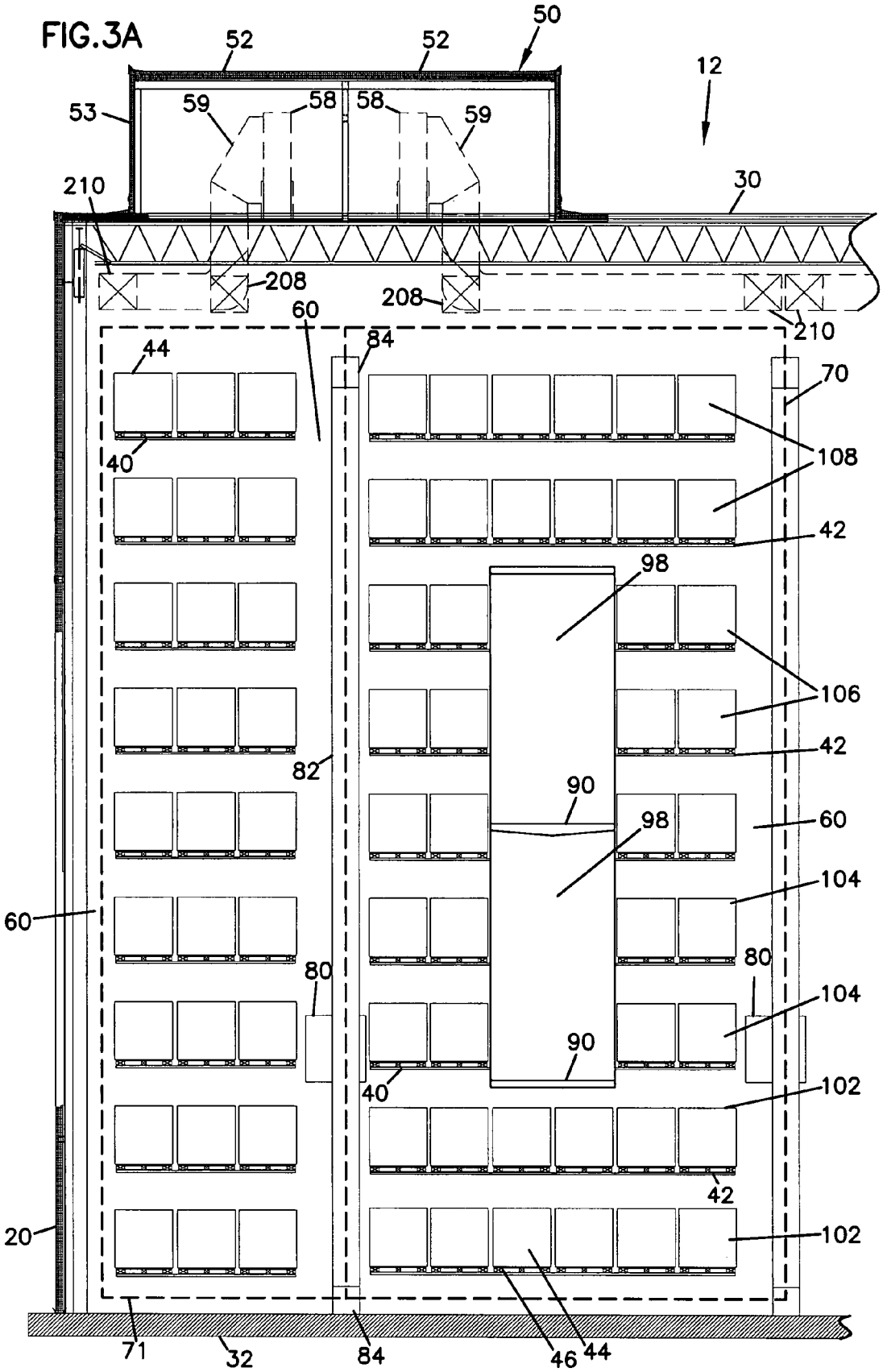
FIG. 3A is a modified freezer room showing internal mezzanines.
Figure 5:
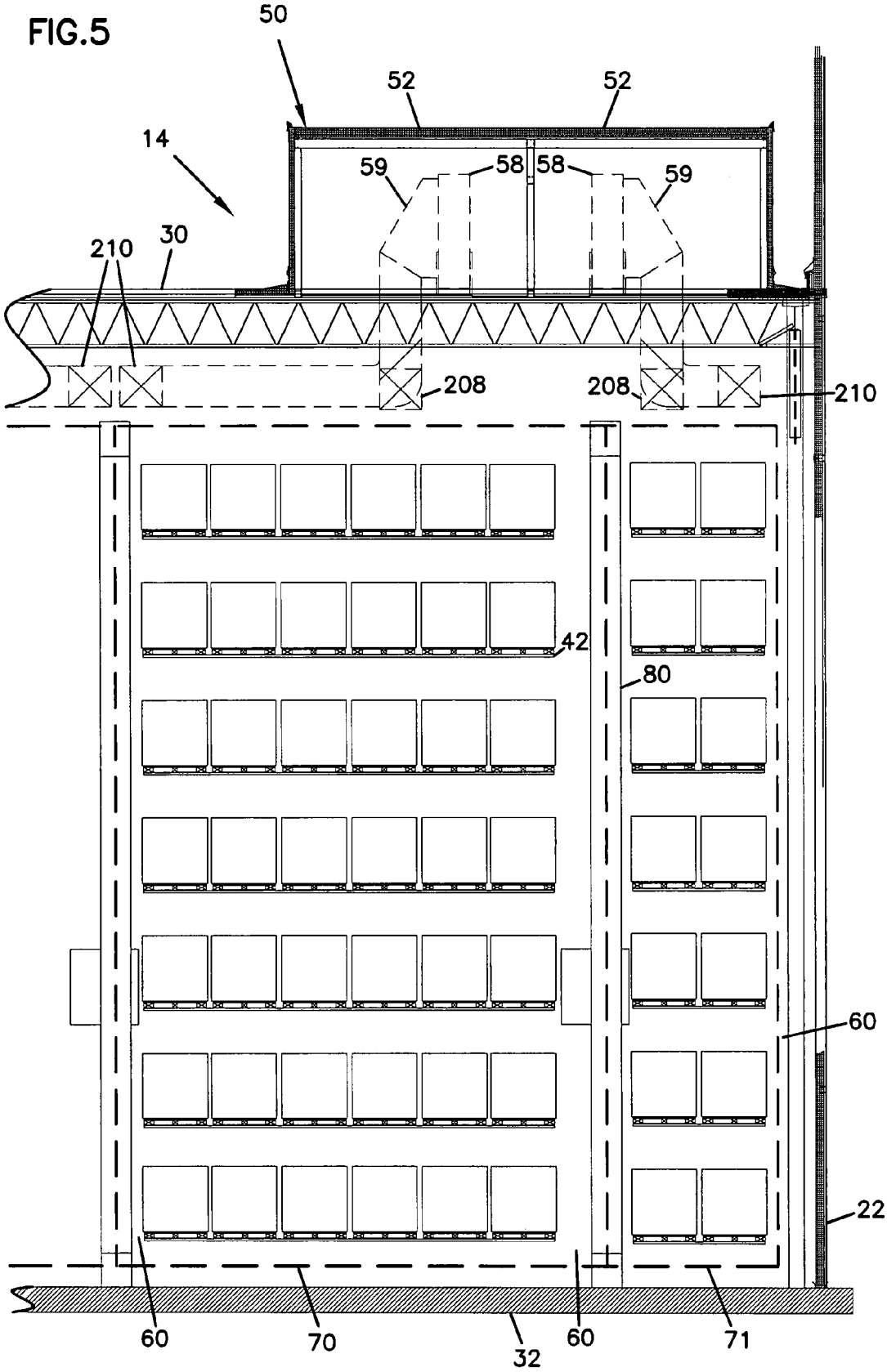
FIG. 5 is an enlarged portion of one side of the cooler room of FIG. 1.
Figure 6:
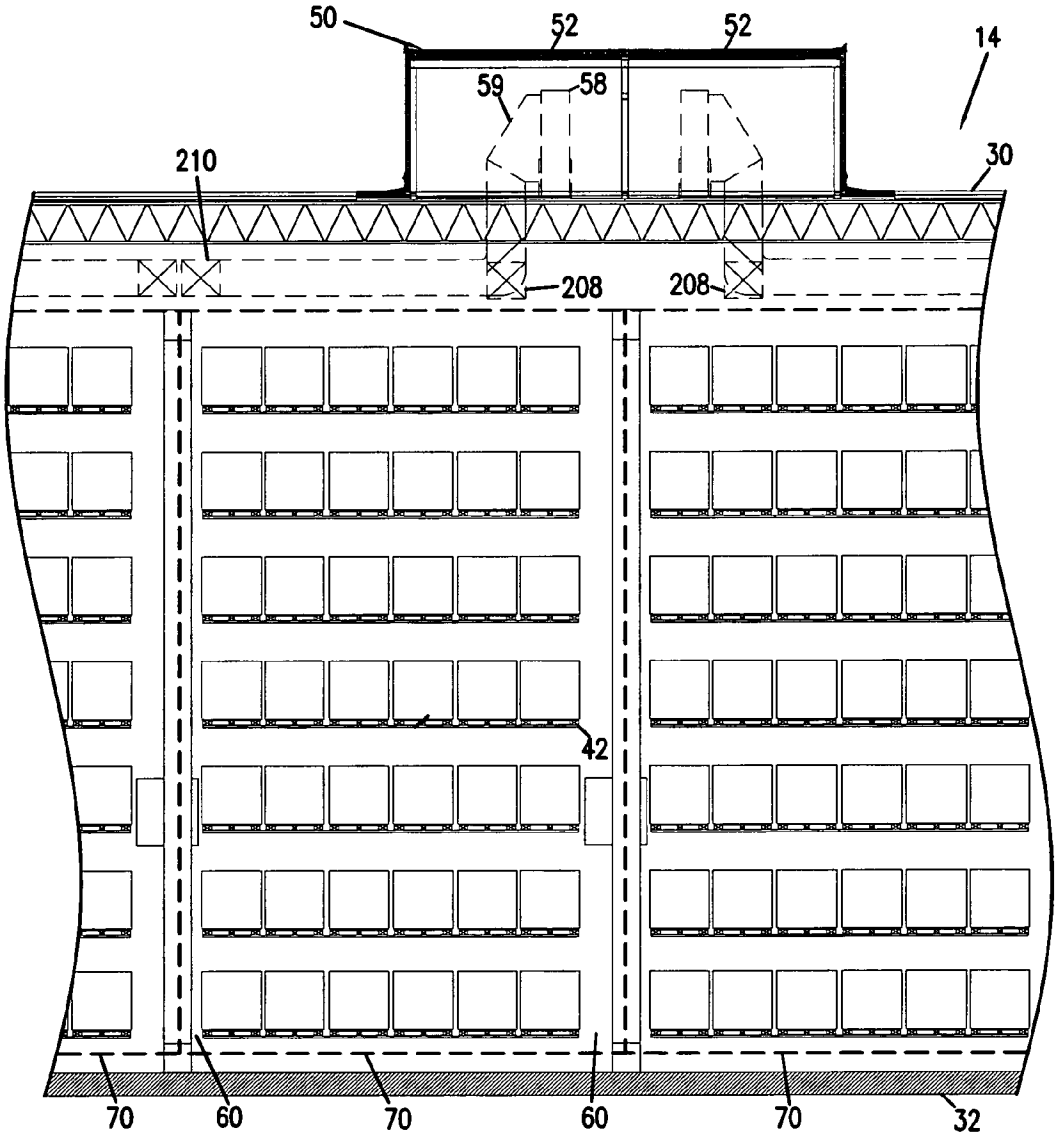
FIG. 6 is an enlarged portion of a middle area of the cooler room of FIG. 1.

End storage zones 71 are similar to storage zones 70, (see FIGS. 3 and 5). However, no equipment is positioned between the end of the racking 40 and walls 20, 22 in the illustrated example.

Cranes 80 located in aisles 60 are just one example of inventory handling equipment useful in aisles 60. Cranes 80 include a moving beam 82 which moves along aisle 60 on tracks 84.

Figure 4:
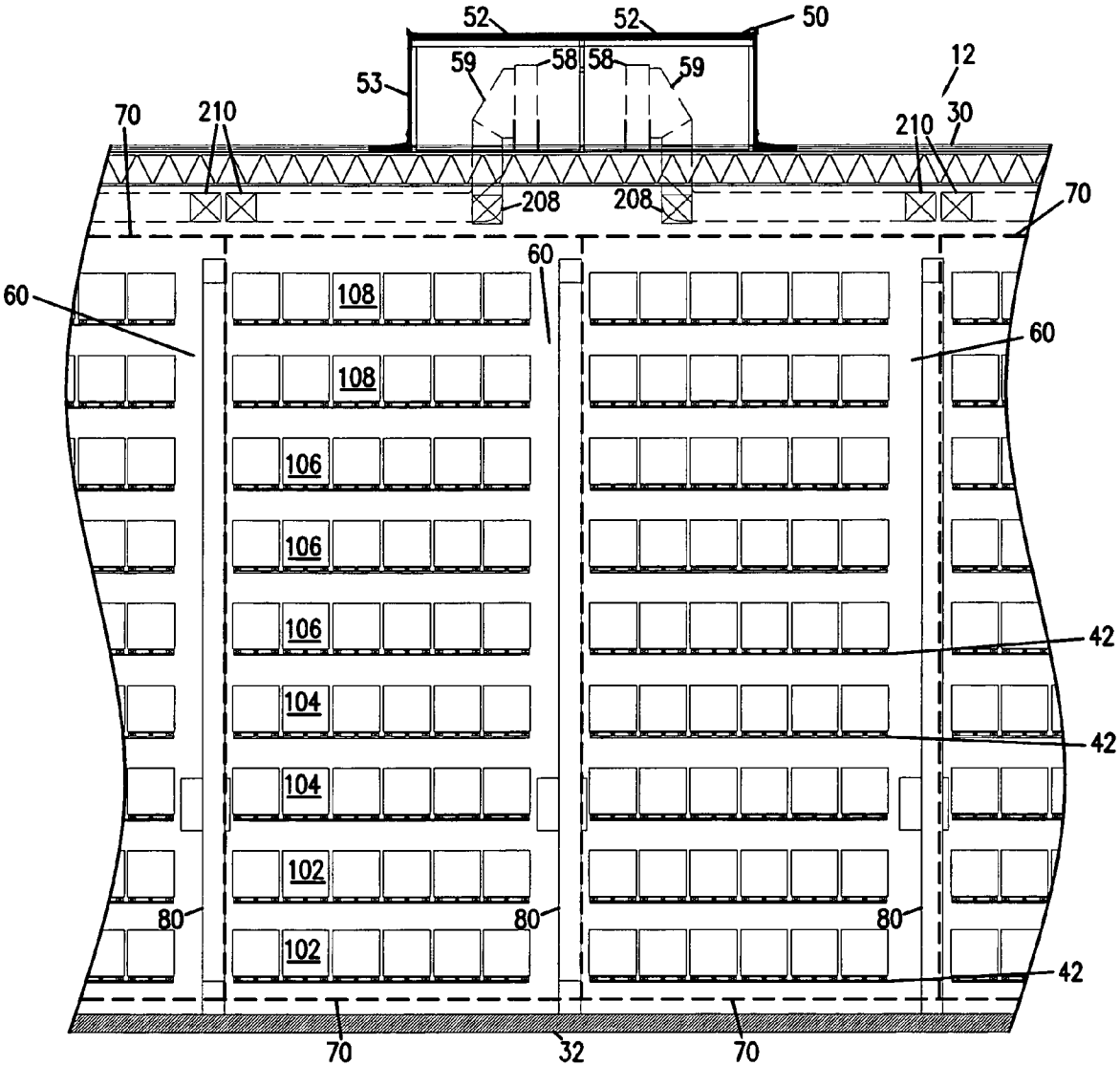
FIG. 4 is an enlarged portion of a middle area of the freezer room of FIG. 1.

As shown in the freezer room 12 in FIGS. 3 and 4, each storage zone 70 includes various vertical levels for inventory storage including lower levels 102, middle levels 104, 106, and upper levels 108. In addition, each level is wider than two boxes 44 from aisle 60 to aisle 60. In the past, such forms of storage were prone to temperature differentials within the cold storage space unless the side walls and ceiling were closely positioned relative to the inventory, or unless various fans, ducting and/or baffles were used around the inventory to assure uniform temperature of the inventory. Variations in temperature could be noted between levels 102, 108 of 10-20 degrees. Variations might also be noticed across each level. Such temperature differentials can create inventory management problems. If such temperature differentials were not identified and managed, inventory shelf life could be drastically reduced for some of the product. In the case of food product, the quality of the food product could deteriorate to the point of spoilage if not stored at the appropriate temperature. Ice cream is one food item that deteriorates and becomes ruined if not stored at a sufficiently cold temperature.

In the past, temperature differentials in the storage space could be managed through the use of various physical structures within the space to more likely evenly distribute the cool air so as to have a more uniform distribution of the cool air across the cold space. However, such physical structures, including floors, walls, fans, and ducting and baffles, often intruded on the inventory storage space or the inventory management and open space. The differentials could also be managed with less dense storage.

By creating storage zones 70 with airflow in the manner of the present invention, a combined dense cold storage and inventory management system can be provided. Lower levels 102, and upper levels 108 can also be provided with different storage functions than middle levels 104, 106, if desired. For example, levels 102, 108 can be reserve storage, and middle levels 104, 106 can be pick storage where product is picked and moved, such as though mezzanines 90, for inventory management.

Figure 7:
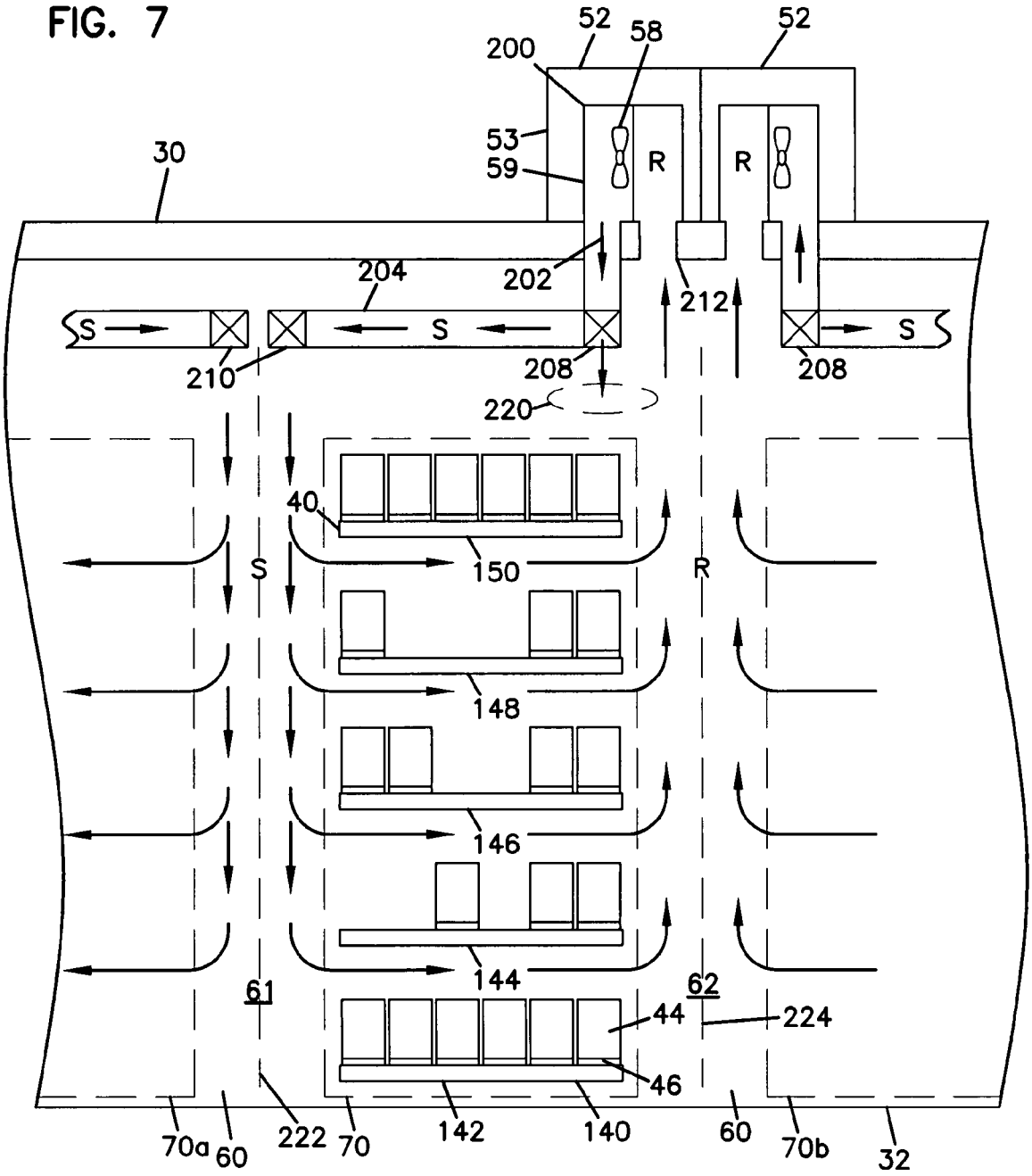
FIG. 7 is a schematic representation of a storage zone in accordance with the present invention.
Figure 8:
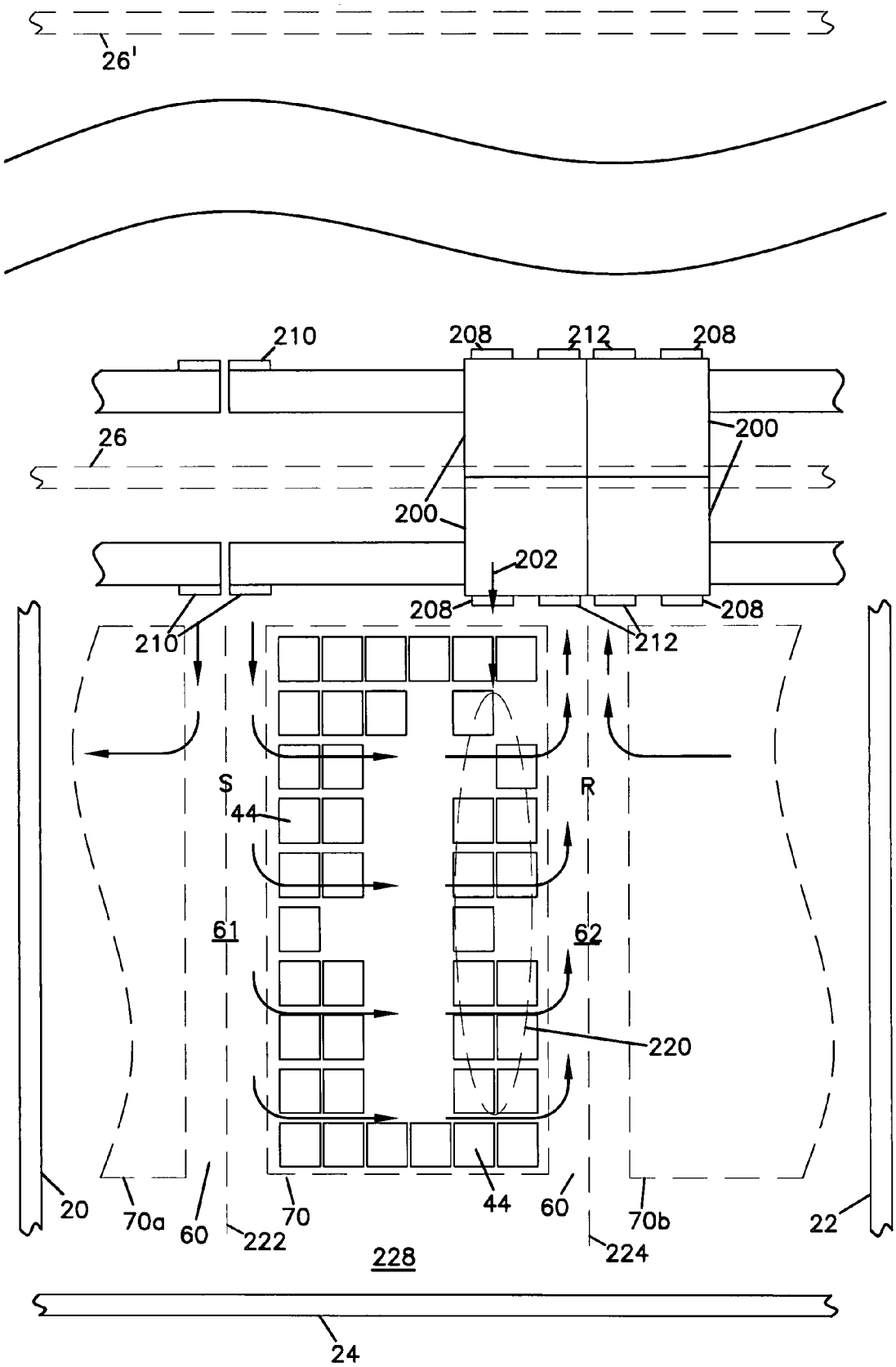
FIG. 8 is top view of the storage zone of FIG. 7.
Figure 9:
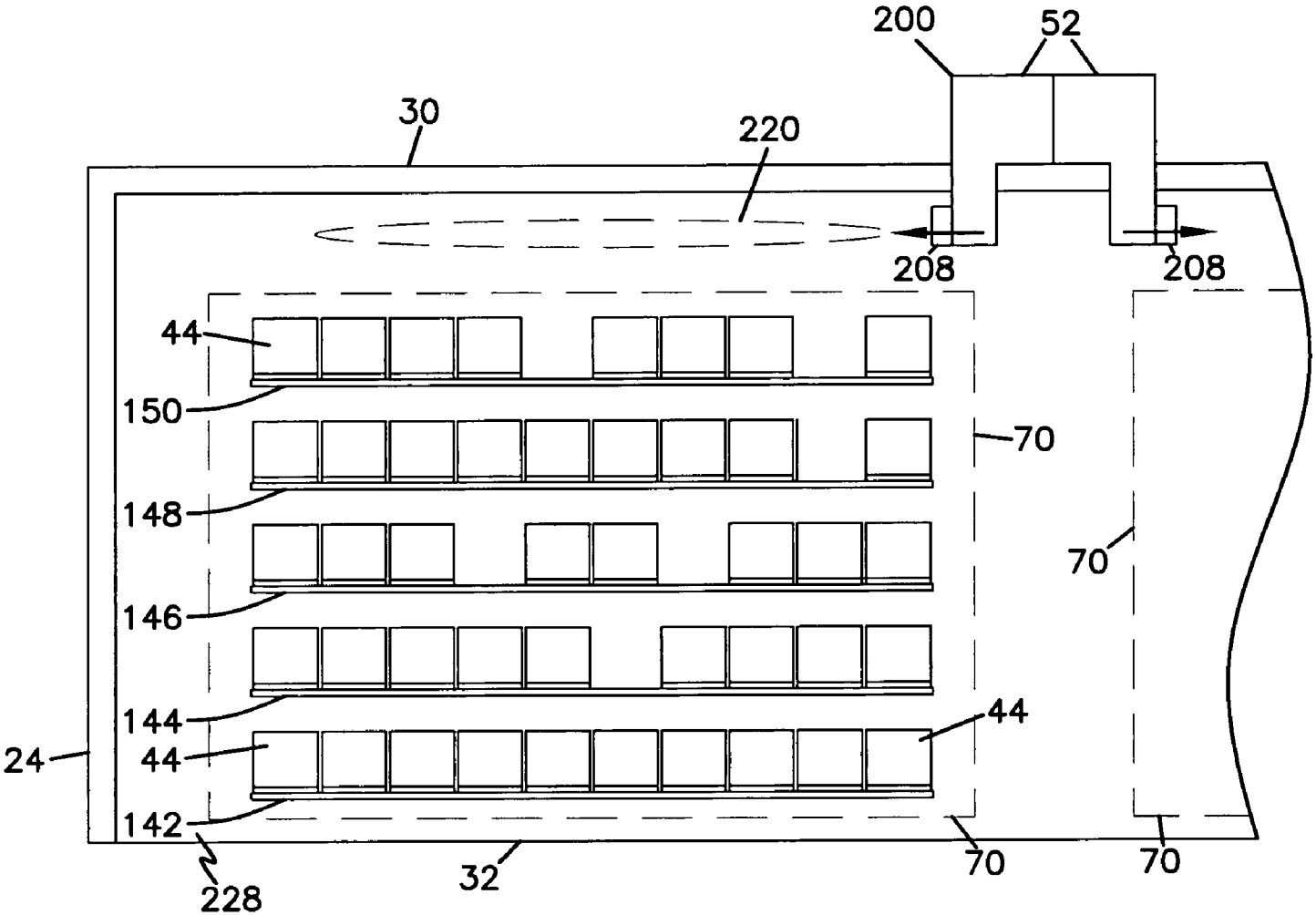
FIG. 9 is a side elevational view of the storage zone of FIG. 7.

Storage zones 70 of the present invention create airflow patterns which allow for dense packing of inventory and access to the inventory as management needs dictate. Referring now to FIGS. 7-9, a temperature controlled facility 110 is illustrated. FIGS. 7-9 represent schematically example rooms 12, 14 and the storage zones 70 discussed above. Rooms 12, 14 of FIGS. 1-6 are just two examples of refrigerated spaces that cool the inventory to desired temperatures, and also allow for inventory management in a dense storage arrangement.

In FIGS. 7-9, racking 140 defines a plurality of storage levels 142, 144, 146, 148, 150 for inventory storage. As shown, inventory is represented by a plurality of boxes 44 on pallets 46. Pallets 46 are useful in some inventory management systems, but are optional depending on the facility. In some storage areas, some boxes 44 are not present. It is anticipated that the present invention achieves desired cooling when the storage areas are completely filled, or less than completely filled as shown for example in FIGS. 7-9. Further, cranes, other handling equipment, and interior mezzanines as described above are optional depending on the facility.

In FIGS. 7-9, aisles 60 separate storage zone 70 from adjacent zones 70*a*, 70*b*. Aisle 61 is a supply air aisle, and aisle 62 is a return air aisle. A blower unit 200 as described above includes a supply of temperature controlled air 202 which passes through ducting 204. Ducting 204 has first and second outlets 208, 210. First outlet 208 is positioned adjacent an upper portion of racking 140. Second outlet 210 is positioned adjacent to aisle 61, designated as a supply air aisle in FIGS. 7-9. Cool air from second outlet 210 passes both downwardly and horizontally from supply air aisle 61 across racking 140 and inventory 44 to return air aisle 62. In this manner, air circulates through storage zone 70.

Air exits from first air outlet 208 adjacent an upper portion of racking 140 to create a pressure barrier 220 to prevent air from moving directly from second air outlet 210 to return air aisle 62 and return duct 212. Such pressure barrier is created by the air throw of the blower unit 200. The pressure barrier 220 is generally the full length of the racking in each storage zone 70. The pressure barrier 220 is created so as to encourage more of the supply air from second air outlet 210 to move down and across all levels of racking 40, 140. Further, use of pressure barrier 220 reduces the emphasis on close positioning of physical structures near a top of racking 40, 140 and the inventory stored thereon.

It is preferred that pressure barrier 220 is created with the cooling air from blower unit 200. However, fans or other sources of moving air can be used to create the pressure barrier 220 if desired.

Further pressure barriers 222, 224 are created in supply air aisle 61 and return aisle 62, respectively, thereby creating the storage zone 70. Blower units 200 are used back-to-back, front-to-front across the cool air space. At the outermost distance of the air throw of the blower units 200, a generally open space 228 can be provided for traffic or equipment.

In addition, further blower units 200 can be positioned in a back-to-back manner in a transverse direction across the space, as shown in FIG. 8. Wall 26 is shown for a single row of blower units 200 arranged back-to-back, front-to-front laterally across the space. Wall 26' is shown for two rows of blower units 200 arranged back-to-back transversely and back-to-back, front-to-front laterally across the space.

By positioning the blower units 200 in the manner illustrated, a zonal effect is created in an otherwise open space. In this manner, cooling air from each blower unit migrates only toward the return side of the respective cooling system to be re-cooled. Supply air aisle 61 and return air aisle 62 are relatively open spaces that can be accessed by human traffic, or inventory handling equipment, such as cranes 80. Further, racking 140 can be constructed to include further inventory management areas, such as the illustrated mezzanines 90, for equipment and traffic pathways.

Racking 40, 140 can be dimensioned as desired for the cold storage facility. In some embodiments, the racking can be 50-100 feet tall, and 80-140 feet long, depending on the air throw distances of the blower units provided in the facility. In the illustrated embodiments, improvements over back to back pallet storage systems are provided. In those prior systems, pallets 48 inches by 40 inches are stored back to back to define a single storage zone. In the present invention, racking 40, 140 can be provided which is more than two boxes or pallets wide, such as five or six pallets wide. For example, instead of racking which is about 8 feet wide, the racking in each zone 70 can be about 27 feet wide.

Figure 7A:
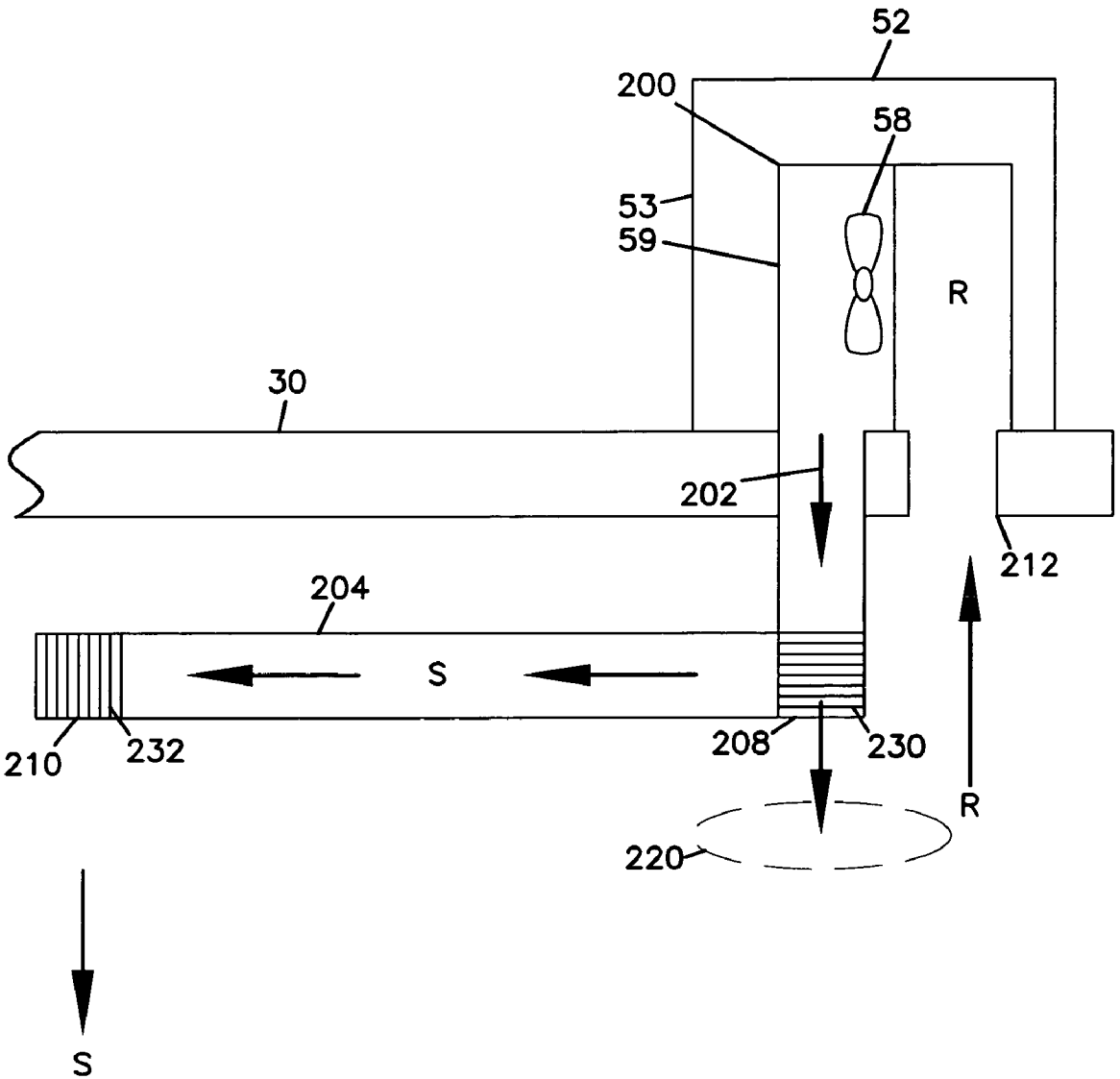
FIG. 7A shows a blower unit and ducting, including louvers for directing airflow.

While the illustrated examples and embodiments are for refrigeration systems, heating systems can also be provided with a similar arrangement for the blower units positioned back-to-back, front-to-front across the space. As shown in FIG. 7A, directional louvers, 230, 232 can be used to direct airflow to create the desired pressure barriers. For example, louver 230 might be used to direct warm air downward at least partially onto the inventory so as to achieve desired heating of the inventory and the desired pressure barrier. Louver 232 is shown with side to side directional control.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A temperature controlled storage facility comprising:

a room having side walls, end walls, a floor, and a ceiling defining a temperature controlled space;

a first plurality of storage zones in the space including a plurality of horizontal storage levels;

wherein the storage zones are spaced apart between the side walls to define a first plurality of supply air aisles and a first plurality of return air aisles, the supply air aisles and the return air aisles alternating across the space between the side walls;

a first plurality of blower units adjacent to the ceiling, one of the blower units positioned over each storage zone, each blower unit including:

a supply of conditioned air;

a first supply air duct connected to the supply of conditioned air with a first supply air outlet, and a second supply air duct connected to the supply of conditioned air with a second supply air outlet distal from the supply of conditioned air, the first supply air outlet intermediate the second supply air outlet and the supply of conditioned air;

a return air duct;

wherein the blower units are arranged front-to-front, and back-to-back across the space;

wherein the first supply air outlet is positioned adjacent to an upper middle area of the respective storage zone, the second supply air outlet is positioned adjacent to a supply air aisle, and the return air duct is positioned adjacent to a return air aisle;

wherein the first plurality of storage zones includes first, second, third, fourth, and fifth storage zones;

wherein the first plurality of blower units includes first, second, third, fourth, and fifth blower units;

wherein each of the respective blower units is located over a respective storage zone;

wherein the storage zones are located adjacent to one another in a linear array across the space;

wherein the second supply air outlets of each of the first and second blower units share a first one of the supply air aisles located between the first and second storage zones;

wherein the return air ducts of each of the second and third blower units share a first one of the return air aisles located between the second and third storage zones;

wherein the second supply air outlets of each of the third and fourth blower units share a second one of the supply air aisles located between the third and fourth storage zones;

wherein the return air ducts of each of the fourth and fifth blower units share a second one of the return air aisles located between the fourth and fifth storage zones.

2. A temperature controlled storage facility according to claim 1, further comprising:

a second plurality of storage zones in the space including a plurality of horizontal storage levels arranged back-to-back with the first plurality of storage zones;

wherein the second plurality of storage zones are spaced apart between the side walls to define a second plurality of supply air aisles and a second plurality of return air aisles, the supply air aisles and the return air aisles of the second plurality of supply air aisles and return air aisles alternating across the space between the side walls, wherein the respective supply air aisles and return air aisles of the first and second plurality of supply and return air aisles are in alignment;

a second plurality of blower units adjacent to the ceiling arranged back-to-back with the first plurality of blower units, one blower unit of the second plurality of blower units positioned over each storage zone of the second plurality of storage zones, each blower unit of the second plurality of blower units including:

a supply of conditioned air;

a first supply air duct connected to the supply of conditioned air with a first supply air outlet, and a second supply air duct connected to the supply of conditioned air with a second supply air outlet distal from the supply of conditioned air, the first supply air outlet intermediate the second supply air outlet and the supply of conditioned air;

a return air duct;

wherein the blower units are arranged front-to-front, and back-to-back across the space;

wherein the first supply air outlet is positioned adjacent to an upper middle area of the respective storage zone, the second supply air outlet is positioned adjacent to a supply air aisle, and the return air duct is positioned adjacent to a return air aisle.

3. A temperature controlled storage facility according to claim 2, further comprising inventory handling equipment in a plurality of the supply air aisles and the return air aisles.

4. A temperature controlled storage facility according to claim 3, further comprising a mezzanine adjacent a middle area of each storage zone, the mezzanine including a floor surface for human traffic.

5. A temperature controlled storage facility according to claim 4, wherein each mezzanine includes inventory handling equipment.

6. A temperature controlled storage facility according to claim 5, wherein air from each blower unit is conditioned to be colder than atmospheric temperature outside the room.

7. A temperature controlled storage facility according to claim 1, further comprising inventory handling equipment in a plurality of the supply air aisles and the return air aisles.

8. A temperature controlled storage facility according to claim 1, further comprising a mezzanine adjacent a middle area of each storage zone, the mezzanine including a floor surface for human traffic.

9. A temperature controlled storage facility according to claim 8, wherein each mezzanine includes inventory handling equipment.

10. A temperature controlled storage facility according to claim 1, wherein air from each blower unit is conditioned to be colder than atmospheric temperature outside the room.

11. A method for controlling the temperature in a storage facility comprising:

providing a room having side walls, end walls, a floor, and a ceiling defining a temperature controlled space;

providing a first plurality of storage zones in the space including a plurality of horizontal storage levels;

wherein the storage zones are spaced apart between the side walls to define a first plurality of supply air aisles and a first plurality of return air aisles, the supply air aisles and the return air aisles alternating across the space between the side walls;

providing a first plurality of blower units adjacent to the ceiling, one of the blower units positioned over each storage zone, each blower unit including:

a supply of conditioned air;

a first supply air duct connected to the supply of conditioned air with a first supply air outlet, and a second supply air duct connected to the supply of conditioned air with a second supply air outlet distal from the supply of conditioned air, the first supply air outlet intermediate the second supply air outlet and the supply of conditioned air;

a return air duct;

wherein the blower units are arranged front-to-front, and back-to-back across the space;

wherein the first supply air outlet is positioned adjacent to an upper middle area of the respective storage zone, the second supply air outlet is positioned adjacent to a supply air aisle, and the return air duct is positioned adjacent to a return air aisle;

wherein the first plurality of storage zones includes first, second, third, fourth, and fifth storage zones;

wherein the first plurality of blower units includes first, second, third, fourth, and fifth blower units;

wherein each of the respective blower units is located over a respective storage zone;

wherein the storage zones are located adjacent to one another in a linear array across the space;

wherein the second supply air outlets of each of the first and second blower units share a first one of the supply air aisles located between the first and second storage zones;

wherein the return air ducts of each of the second and third blower units share a first one of the return air aisles located between the second and third storage zones;

wherein the second supply air outlets of each of the third and fourth blower units share a second one of the supply air aisles located between the third and fourth storage zones;

wherein the return air ducts of each of the fourth and fifth blower units share a second one of the return air aisles located between the fourth and fifth storage zones;

creating an upper pressure barrier from airflow from the first supply air outlet adjacent to a top of each of the storage zones;

creating a supply side pressure barrier from airflow from the second supply air outlet adjacent to a side of each of the storage zones;

creating a return air pressure barrier from airflow within the return air aisle adjacent to an opposite side of each of the storage zones.

12. A method according to claim 11, further comprising:

providing a second plurality of storage zones in the space including a plurality of horizontal storage levels arranged back-to-back with the first plurality of storage zones;

wherein the second plurality of storage zones are spaced apart between the side walls to define a second plurality of supply air aisles and a second plurality of return air aisles, the supply air aisles and the return air aisles of the second plurality of supply air aisles and return air aisles alternating across the space between the side walls, wherein the respective supply air aisles and return air aisles of the first and second plurality of supply and return air aisles are in alignment;

providing a second plurality of blower units adjacent to the ceiling arranged back-to-back with the first plurality of blower units, one blower unit of the second plurality of blower units positioned over each storage zone of the second plurality of storage zones, each blower unit of the second plurality of blower units including:

a supply of conditioned air;

a first supply air duct connected to the supply of conditioned air with a first supply air outlet, and a second supply air duct connected to the supply of conditioned air with a second supply air outlet distal from the supply of conditioned air, the first supply air outlet intermediate the second supply air outlet and the supply of conditioned air;

a return air duct;

wherein the blower units are arranged front-to-front, and back-to-back across the space;

wherein the first supply air outlet is positioned adjacent to an upper middle area of the respective storage zone, the second supply air outlet is positioned adjacent to a supply air aisle, and the return air duct is positioned adjacent to a return air aisle;

creating an upper pressure barrier from airflow from the first supply air outlet adjacent to a top of each of the storage zones of the second plurality of storage zones;

creating a supply side pressure barrier from airflow from the second supply air outlet adjacent to a side of each of the storage zones of the second plurality of storage zones;

creating a return air pressure barrier from airflow within the return air aisle adjacent to an opposite side of each of the storage zones of the second plurality of storage zones.

13. The method of claim 12, wherein air from each blower unit is conditioned to be colder than atmospheric temperature outside of the room.

14. The method of claim 11, wherein air from each blower unit is conditioned to be colder than atmospheric temperature outside of the room.

15. The method of claim 11, wherein at least one of the storage zones is at least 50 feet tall, at least 80 feet long, and at least more than two pallets wide.

16. The method of claim 15, wherein the at least one storage zone is at least 27 feet wide.

17. The method of claim 15, wherein the at least one storage zone is at least three pallets wide.

18. The method of claim 17, wherein the at least one storage zone is at least five pallets wide.

19. The method of claim 11, wherein at least two of the first plurality of the storage zones are at least more than two pallets wide.

20. The method of claim 19, wherein the at least two of the first plurality of the storage zones are at least five pallets wide.

21. A temperature controlled storage facility comprising:

a room having side walls, end walls, a floor, and a ceiling defining a temperature controlled space;

a first plurality of storage zones in the space including a plurality of horizontal storage levels;

wherein the storage zones are spaced apart between the side walls to define a plurality of supply air aisles and a plurality of return air aisles, the supply air aisles and the return air aisles alternating across the space between the side walls;

a plurality of first blower units and a plurality of second blower units, wherein the first blower units and the second blower units alternate across the space between the side walls, with one of the first and the second blower units positioned above each storage zone;

each of the first and second blower units including:

a penthouse above the ceiling including a supply of conditioned air;

a first supply air duct connected to the supply of conditioned air with a first supply air outlet, and a second supply air duct connected to the supply of conditioned air with a second supply air outlet distal from the supply of conditioned air, the first supply air outlet intermediate the second supply air outlet and the supply of conditioned air;

a return air duct;

wherein the first supply air outlet is positioned adjacent to an upper middle area of the respective storage zone, the second supply air outlet is positioned adjacent to a supply air aisle, and the return air duct is positioned adjacent to a return air aisle;

wherein the second supply air ducts extend in a direction toward one side wall for the plurality of first blower units, and the second supply air ducts extend in a direction toward the other side wall for the plurality of second blower units;

wherein the penthouses are arranged in pairs, with a penthouse of one of the plurality of first blower units adjacent to the penthouse of one of the plurality of second blower units;

wherein the blower units are arranged front-to-front, and back-to-back across the space, such that the second supply air outlets are adjacent to each other and the return air ducts are adjacent to each other for the alternating first and second blower units across the space.

* * * * *